US008290416B2

(12) United States Patent
Kim

(10) Patent No.: US 8,290,416 B2
(45) Date of Patent: Oct. 16, 2012

(54) FUSING UNIT INCLUDING SUPPORTING MEMBERS TO SUPPLY LUBRICANT AND IMAGE FORMING APPARATUS INCLUDING THE SAME

(75) Inventor: Jeong-hwa Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 318 days.

(21) Appl. No.: 12/179,930

(22) Filed: Jul. 25, 2008

(65) Prior Publication Data

US 2009/0041515 A1 Feb. 12, 2009

(30) Foreign Application Priority Data

Aug. 6, 2007 (KR) ..... 10-2007-0078789

(51) Int. Cl.
*G03G 15/20* (2006.01)

(52) U.S. Cl. ..... 399/329; 399/67; 399/320

(58) Field of Classification Search ..... 399/329, 399/122, 320

See application file for complete search history.

(56) References Cited

U.S. PATENT DOCUMENTS 6,456,819 B1 * 9/2002 Abe et al. ..... 399/329
2006/0182474 A1 8/2006 Naito et al.

FOREIGN PATENT DOCUMENTS

JP 2001-042670 2/2001
JP 2006-227106 8/2006

OTHER PUBLICATIONS

Korean Office Action mailed Sep. 29, 2011 in corresponding Application No. 2011-056054222.

* cited by examiner

*Primary Examiner* — Walter L Lindsay, Jr.
*Assistant Examiner* — Roy Y Yi
(74) *Attorney, Agent, or Firm* — Staas & Halsey LLP

(57) ABSTRACT

A fusing unit of an image forming apparatus and image forming apparatus are provided. The fusing unit includes a belt and end supporting members. The supporting members are disposed at opposing ends of the belt and support a rotation of the belt. At least one of the end supporting members includes a lubricant container that is formed in a surface of the supporting member and that supplies a lubricant to lubricate the rotation of the belt.

21 Claims, 14 Drawing Sheets

FUSING UNIT INCLUDING SUPPORTING MEMBERS TO SUPPLY LUBRICANT AND IMAGE FORMING APPARATUS INCLUDING THE SAME

CROSS-REFERENCE TO RELATED APPLICATION

This application claims all benefits accruing under 35 U.S.C. §119 from Korean Patent Application No. 2007-78789, filed on Aug. 6, 2007, in the Korean Intellectual Property Office, the disclosure of which is incorporated herein by reference.

BACKGROUND OF THE INVENTION

1. Field of the Invention

Aspects of the present invention relate to a fusing unit and an image forming apparatus including the same, and more particularly, to a fusing unit that has improved durability, and an image forming apparatus including the same.

2. Description of the Related Art

An electrophotographic image forming apparatus forms an image on a printing medium through charging-exposing-developing-transferring-fusing-cleaning processes. Exemplary electrophotographic image forming apparatuses include a laser printer, a photocopier, a facsimile machine, a multifunctional device, etc. An electrophotographic image forming apparatus includes a fusing unit which performs the fusing process. The fusing unit fuses a visible image formed of a developer to a printing medium, with heat and pressure.

The fusing unit includes a heated body, a heating member, which heats the heated body, and a pressure member, which presses the printing medium to the heated body. The fusing unit may be classified into a belt-type or a roller-type, depending on the type of the heated body.

The belt-type fusing unit may be classified into a tension belt-type or a non-tension belt-type. The non-tension belt-type fusing unit is popular, since it loses less heat and reduces material costs, as compared to the tension belt-type fusing unit, which includes two belt driving rollers.

The non-tension belt-type fusing unit includes two end-supporting members, to rotatably support opposite ends of the belt in a transverse direction, with respect to a rotation direction of the belt. A lubricant is applied to surfaces of the end supporting members, which contact the belt, such that the belt smoothly rotates, and to reduce wear of the belt, due to the friction. However, as the belt rotates, the lubricant leaks, and moves out of the contact surfaces. Then, the belt may be worn and/or damaged by the friction with the end supporting members.

To address the foregoing problem, Japanese Patent First Publication No. 2006-227106 suggests installing a sealing ring on surfaces of the end supporting members, which contact the belt, to prevent the lubricant from leaking. However, the foregoing apparatus does not prevent the lubricant from leaking to an opposite side, which does not have the sealing ring. If the number of the sealing rings increases, the lubricant is stuck between the sealing rings, and is less effective in lubricating the contact surfaces. Moreover, the lubricant continues to leak from the side that does not have the sealing ring. Thus, there are limitations in preventing the lubricant leakage, using only the sealing rings.

SUMMARY OF THE INVENTION

Aspects of the present invention provide a fusing unit that has improved durability, and an image forming apparatus including the same.

Aspects of the present invention provide a fusing unit that prevents opposite ends of a belt from being damaged by friction, and an image forming apparatus including the same.

Aspects of the present invention provide a fusing unit, in which a lubricant remains between a belt and end supporting members, which support opposite ends of the belt, for a long time, and an image forming apparatus including the same.

Aspects of the present invention relate to a fusing unit of an image forming apparatus, including: a belt; first and second end supporting members disposed at opposing ends of the belt, to support a rotation of the belt; and a lubricant container that is formed in the surface of at least one of the first and second end supporting members, to supply a lubricant to lubricate the rotation of the belt.

According to aspects of the invention, the lubricant container may include a groove. The groove may extend in a direction that is substantially parallel to a rotational axis of the belt, substantially perpendicular to the rotational axis, or offset from the rotational axis.

According to aspects of the invention, the lubricant container may extend in a direction that is substantially parallel to a rotational axis of the belt, substantially perpendicular to the rotational axis, or offset from the rotational axis.

According to aspects of the invention, the lubricant container may include a plurality of dents disposed on the surface of at least one of the first and second end supporting members.

According to aspects of the invention, at least one of the first and second end supporting members may include a lubricant storage unit to store the lubricant, and a lubricant communication path to connect the lubricant storage unit and the lubricant container.

According to aspects of the invention, provided is an image forming apparatus, including: an image forming unit, which forms an image on a printing medium with a developer; and a fusing unit to fuse the developer to the printing medium. The fusing unit includes a belt, first and second end supporting members disposed at opposing ends of the belt, to support a rotation of the belt, and a lubricant container formed in the surface of at least one of the first and second end supporting members, to supply a lubricant to lubricate the rotation of the belt.

According to aspects of the invention, the lubricant container may be formed as at least one groove.

According to aspects of the invention, the groove may extend in a direction that is substantially parallel to a rotational axis of the belt, substantially perpendicular to the rotational axis, or offset from the rotational axis.

According to aspects of the invention, the lubricant container may extend in a direction that is substantially parallel to a rotational axis of the belt, substantially perpendicular to the rotational axis, or offset from the rotational axis.

According to aspects of the invention, the lubricant container may include a plurality of dents formed in the surface of the first and/or second lubricant containers.

According to aspects of the invention, at least one of the first and second end supporting members may include a lubricant storage unit to store the lubricant, and a lubricant communication path to connect the lubricant storage unit and the lubricant container communicate.

In addition to the exemplary embodiments and aspects as described above, further aspects and embodiments will be apparent, by reference to the drawings, and by study of the following descriptions.

BRIEF DESCRIPTION OF THE DRAWINGS

A better understanding of the aspects of the present invention will become apparent from the following detailed description of exemplary embodiments and the claims, when read in connection with the accompanying drawings, all forming a part of the disclosure of this invention. While the following written and illustrated disclosure focuses on disclosing exemplary embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EXEMPLARY EMBODIMENTS

Figure 1:
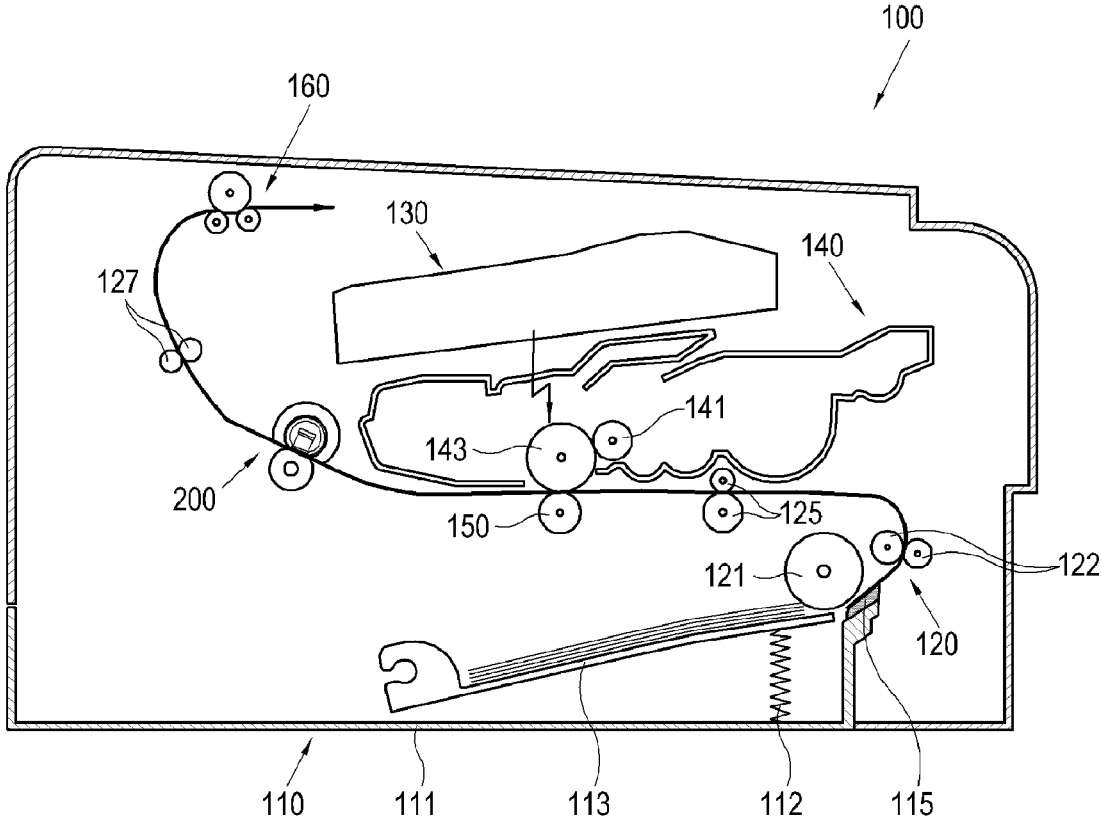
FIG. 1 is a schematic sectional view of an image forming apparatus, according to an exemplary embodiment of the present invention.

Reference will now be made in detail to the exemplary embodiments of the present invention, examples of which are illustrated in the accompanying drawings, wherein like reference numerals refer to the like elements throughout. The exemplary embodiments are described below, in order to explain the aspects of present invention, by referring to the figures.

As shown in FIG. 1, an electrophotographic image forming apparatus 100, according to aspects of the present invention, may include a paper feeding cassette 110, a printing medium feeder 120, a light scanning unit 130, a developing cartridge 140, a transfer unit 150, a fusing unit 200, and a discharging unit 160.

The paper feeding cassette 110 includes a plate 113, an elastic member 112, a friction pad 115, and a cassette casing 111 that accommodates the foregoing elements. Printing medium is stacked on the plate 113, which is supported by the elastic member 112. The printing medium is picked up by a pickup roller 121. The picked printing medium is separated into individual sheets by the friction pad 115, and fed to a registration roller 125, through a feed roller 122. The printing medium can be paper, transparencies, or the like.

The registration roller 125 arranges the printing medium fed by the feed roller 122, and feeds the printing medium to the developing cartridge 140, according to an exposure time of the light scanning unit 130 (to be described later).

The light scanning unit 130 scans light to a photosensitive body 143 of the developing cartridge 140. The light scanning unit 130 forms an electrostatic latent image on a surface of the photosensitive body 143.

The developing cartridge 140 includes a developer storage unit (not shown), to store the developer, a developing roller 141, and the photosensitive body 143. The developing roller 141 develops the electrostatic latent image on the surface of the photosensitive body 143, with the developer stored in the developing cartridge 140, to form a visible image.

The visible image is transferred to the printing medium passing between the photosensitive body 143 and the transfer unit 150, by the transfer unit 150 facing the photosensitive body 143. The visible image is fused to the printing medium, by heat and pressure from the fusing unit 200. The printed printing medium is discharged to the outside, through the feed roller 127 and discharging rollers 163 and 165, of the discharging unit 160.

Figure 2:
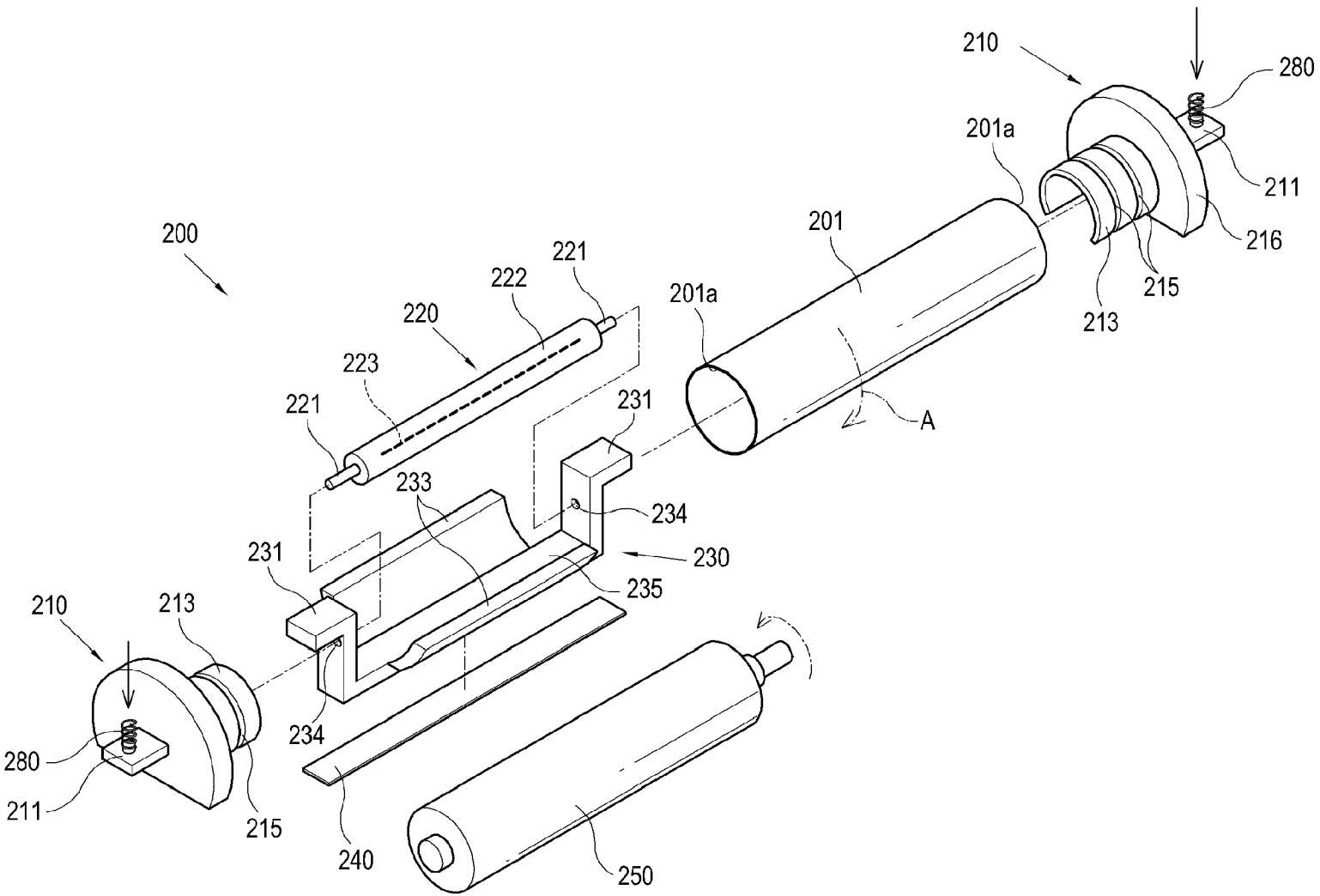
FIG. 2 is schematic perspective view of a fusing unit of FIG. 1.

As shown in FIGS. 1 and 2, the fusing unit 200, according to aspects of the present invention, includes a belt 201, a pair of end supporting members 210 that support opposite ends of the belt 201, which are disposed along a rotational axis of the belt 201, a heating member 220, a belt guide 230, a nip forming member 240, and a pressure member 250. The belt 201 rotates in the direction A, around the rotational axis.

The belt 201 can be a flexible endless belt. The belt 201 may include a heat resistant resin film, such as, polyamide, polyamide imide, PEEK (polyether ether ketone), and/or PES (polyether sulfone). The belt 201 can have a small heat capacity. The belt 201 may include a metal sleeve, which is coated on a surface of a thin metal tube, as necessary. The belt 201 can be any suitable type of belt, and as such, a detailed description thereof is omitted herein.

The heating member 220, the belt guide 230, and the nip forming member 240 are accommodated in the belt 201. Opposing ends 201*a* of the belt 201 are rotatably supported by the end supporting members 210.

The end supporting members 210 include supporters 213, which support internal circumferences of the opposite ends 201*a* of the belt 201. The end supporting members 210 include separation prevention units 216, which prevent the belt 201 from being displaced along the rotational axis. The end supporting members 210 may further include elastic member installing units 211, which are provided on sides of the separation prevention units 216, opposite to the supporters 213. An elastic member 280 is installed on the elastic member installing unit 211, to elastically bias the end supporting members 210 toward the pressure member 250.

Lubricant containers 215 are provided on the external surfaces of the supporters 213 of the end supporting members 210, to reduce friction between the belt 201 and the end supporting members 210, when the belt 201 rotates.

The lubricant containers 215 may be grooves formed in the rotation direction A of the belt 201. The end supporting members 210 can be paired at the opposite ends 201*a* of the belt 201, to reduce production costs. Depending on an application environment, different types of lubricant containers 215 may be employed in the end supporting members 210. That is, the shape of the end supporting members 210, and/or the shape/orientation of the lubricant containers 215 may be altered. A lubricant container 215 may be provided only in one of the end supporting members 210, in some exemplary embodiments. A lubricant can be filled into the lubricant containers 215, before the end supporting members 210 are inserted into the belt 201.

Figure 3A:
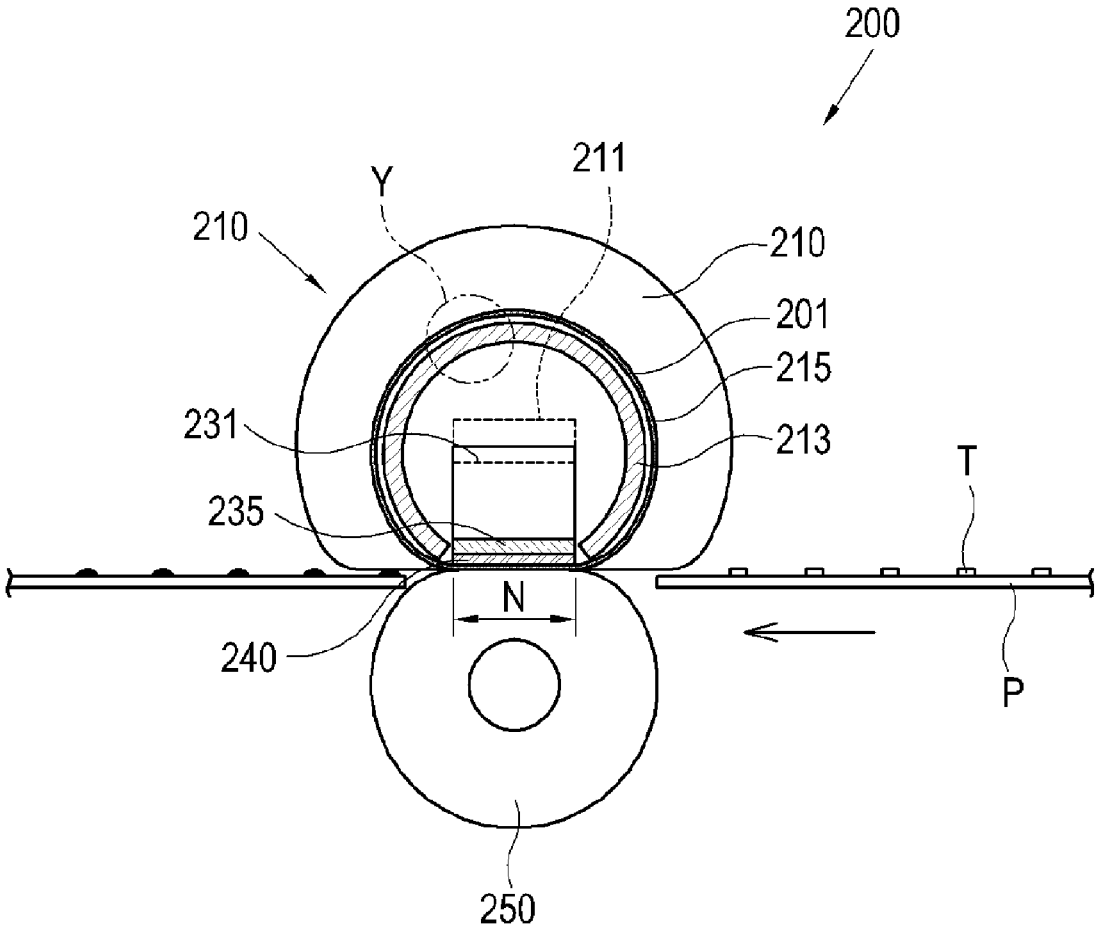
FIG. 3A is a schematic sectional view of the fusing unit of FIG. 2.
Figure 3B:
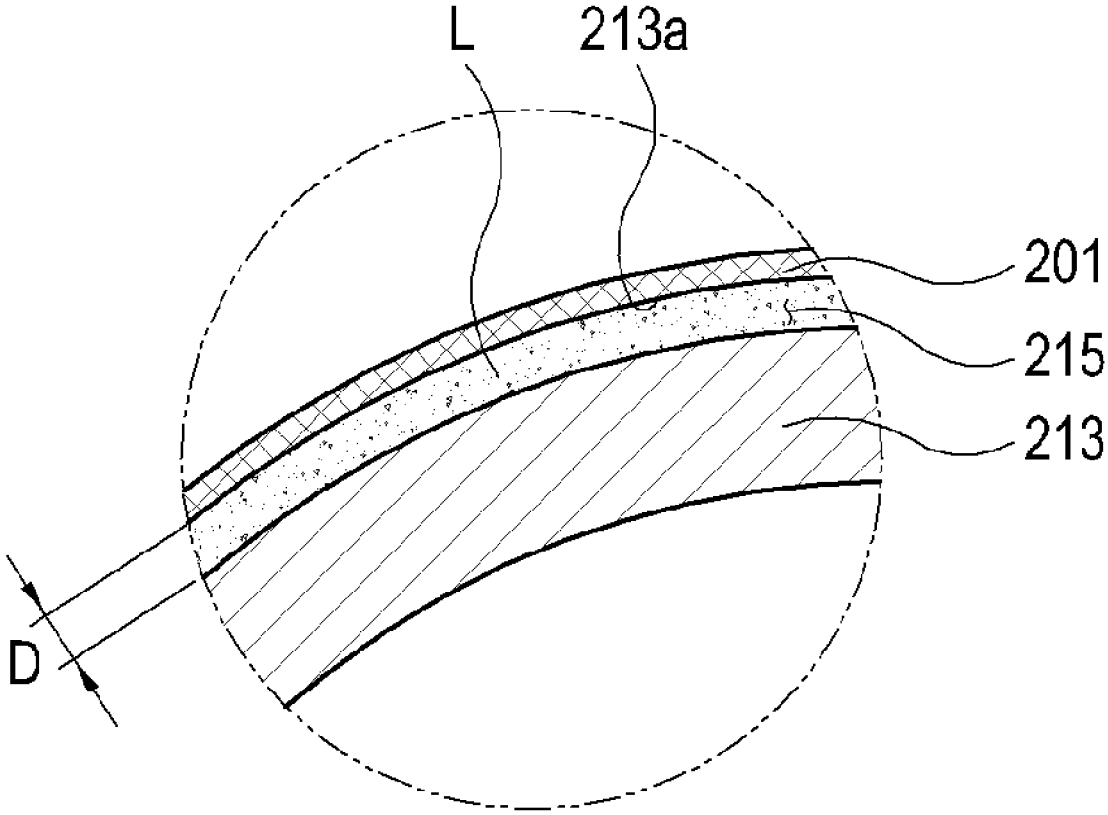
FIG. 3B is an enlarged view of a part Y of the fusing unit of FIG. 3A.

As shown in FIG. 3B, a depth D, from a belt contacting surface 213*a* of one of the supporters 213, ranges from approximately 0.1 mm to 1 mm. If the depth D is too deep, a step (a gap between the belt contacting surface 213*a* and an inner surface of the supporter 213) may become too large from the belt contacting surface 213*a*. In such a case, the belt 201 may be wrinkled, or the printing medium may be bent. If the depth D is too shallow, the lubricant may not fill the lubricant containers 215 properly.

The heating member 220 may include a glass tube 222, a filament 223 in the glass tube 222, and electrode brushes 221, which supply power to the filament 223. The filament 223 can be a tungsten filament. The heating member 220 is typically referred to as a heat lamp.

The electrode brushes 221 may pass through holes 234 of the belt guide 230. The electrode brushes 221 may be exposed outside of the belt 201, to receive power from the outside. The heating member 220 may be supported by the through holes 234 of the belt guide 230.

The belt guide 230 includes pressed parts 231, a coupling part 235 coupled with the nip forming member 240, and guide pieces 233. The pressed parts 231 contact the surfaces of the elastic member installing units 211, of the end supporting members 210, and are biased toward the pressure member 250, together with the end supporting members 210. Alternatively, the pressed parts 231 may be connected with the end supporting members 210 in various ways, as long as the pressed parts 231 are biased with the end supporting members 210.

The guide pieces 233 prevent the flexible belt 201 from being excessively deformed during the rotation thereof. The guide pieces 233 may be substantially arc-shaped.

The nip forming member 240 is coupled with the planar coupling part 235 of the belt guide 230, and is accommodated in the belt 201. The nip forming member 240 planarizes the contact surfaces of the pressure member 250 and the belt 201, to enlarge the surface area of the contact surfaces. The nip forming member 240 may be a metal plate.

The pressure member 250 is biased toward the nip forming member 240, by the elastic members 280. An elastic layer including heat resistant rubber, is formed on an external surface of the pressure member 250, to form a nip between the nip forming member 240 and the pressure member 250.

The pressure member 250 is rotatably driven by a motor (not shown). As the pressure member 250 is driven, the belt 201, which is pressed between the nip forming member 240 and the pressure member 250, is rotated by friction, according to the rotation of the pressure member 250.

FIG. 3A is a cross-sectional view of the fusing unit 200. As shown therein, a nip N is formed by pressing together the nip forming member 240 and the pressure member 250.

If power is supplied to the heating member 220, the heating member 220 heats the belt 201 surrounding the heating member 220. A developer T applied to the printing medium P may be fused to the printing medium P, by heat from the belt 201, and by the pressure from the nip N, while passing through the nip N.

FIG. 3B is an enlarged view of the portion Y of FIG. 3A. As a lubricant L fills the lubricant container 215, the movement of the lubricant L, due to the rotation of the belt 201, may be minimized. Thus, the lubricant L may remain on the belt contacting surface 213*a* for a long time. As the lubricant container 215 is formed in the belt contacting surface 213*a* of the supporter 213, the contact area between the belt 201 and the supporter 213 is small, and friction between the belt 201 and the supporter 213 is reduced. The lubricant container 215 is formed in the rotation direction A of the belt 201, thereby further reducing the friction between the belt 201 and the supporter 213.

Figure 4:
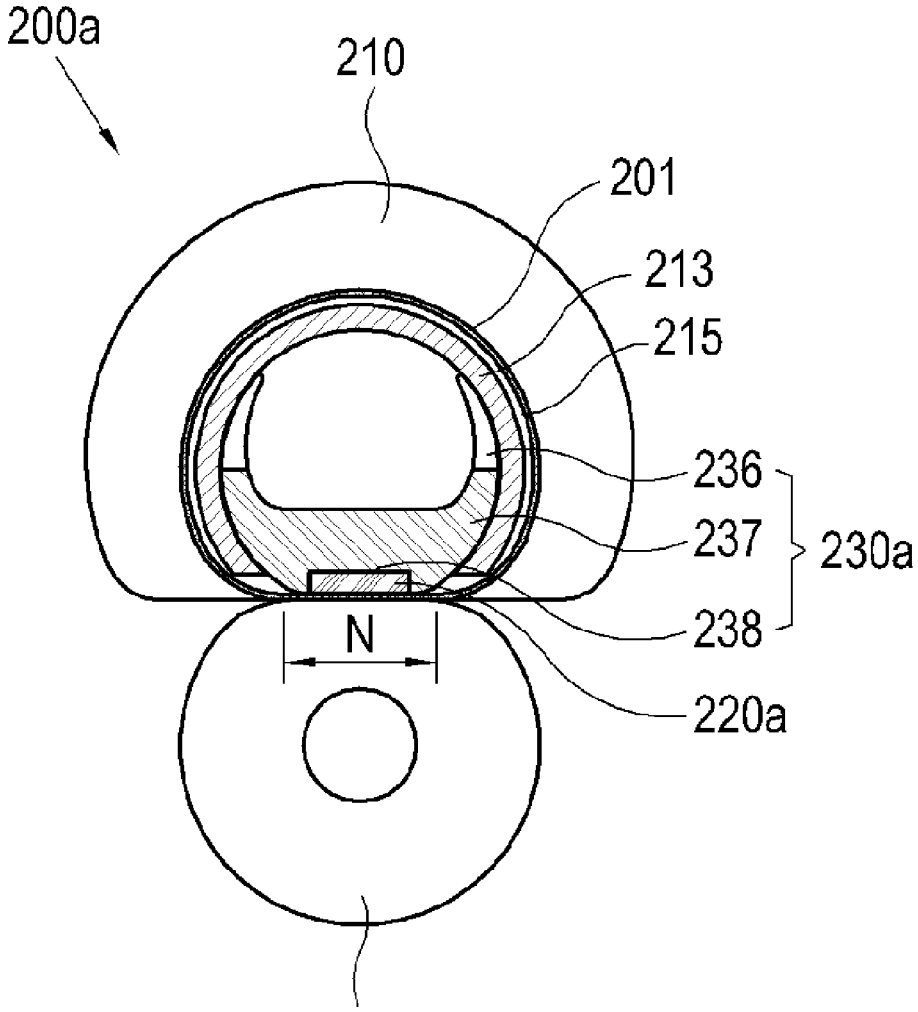
FIG. 4 is a schematic sectional view of an exemplary embodiment of a fusing unit.

FIG. 4 is a schematic sectional view of a fusing unit 200*a*, according to an exemplary embodiment of the present invention. The fusing unit 200*a* includes end supporting members 210 to support opposite ends of the belt 201, a belt guide 230*a*, a ceramic heater 220*a*, and a pressure member 250. Elements equivalent to the foregoing elements will be not be described.

The belt guide 230*a* includes a main body 237 that extends along a rotational axis of the belt 201, arcuate guide pieces 236 that extend from the main body 237, to control the deformation of the belt 201, during rotation of the belt 201, and a supporting groove 237 that supports the ceramic heater 220*a*.

The ceramic heater 220*a* is inserted into the supporting groove 237, adjacent to a nip N. The ceramic heater 220*a* may rapidly heat the belt 201.

As the fusing unit 220*a* employs the end supporting members 210 including the lubricant containers 215, the lubricant remains in the lubricant containers 215, even if the belt 201 is driven for an extended period. Thus, friction applied to the belt 201 is minimized, thereby extending the life span of the belt 201.

Figure 5:
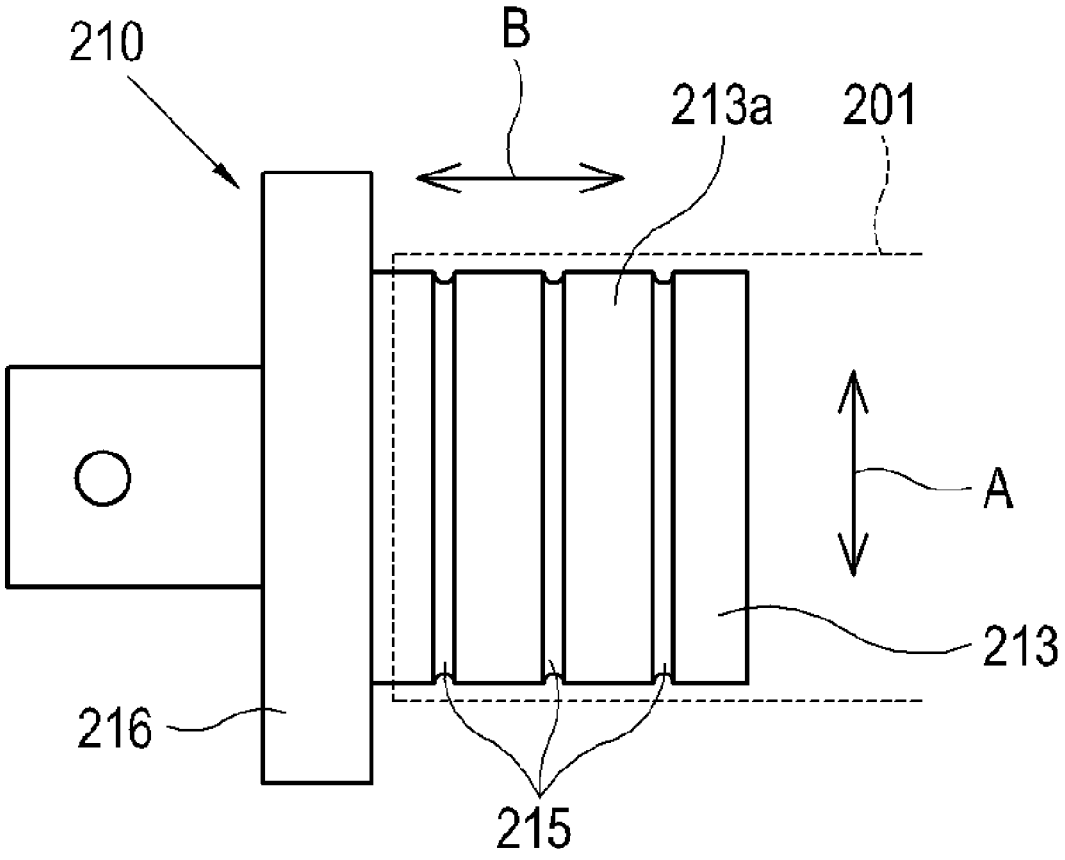
FIG. 5 is an enlarged plan view of end supporting members of the fusing unit of FIG. 2.

FIG. 5 is an enlarged plan view of the end supporting member 210, of the fusing unit 200 of FIG. 2. Three lubricant containers 215 are shown, but the present invention is not limited to any specific number of lubricant containers 215. For example, multiple lubricant containers 215 can be used or a single lubricant container 215 can be used. A separation prevention unit 216 protrudes from an external circumference 213*a* of the supporter 213, and prevents the belt 201 from being separated in a direction B.

Figure 6:
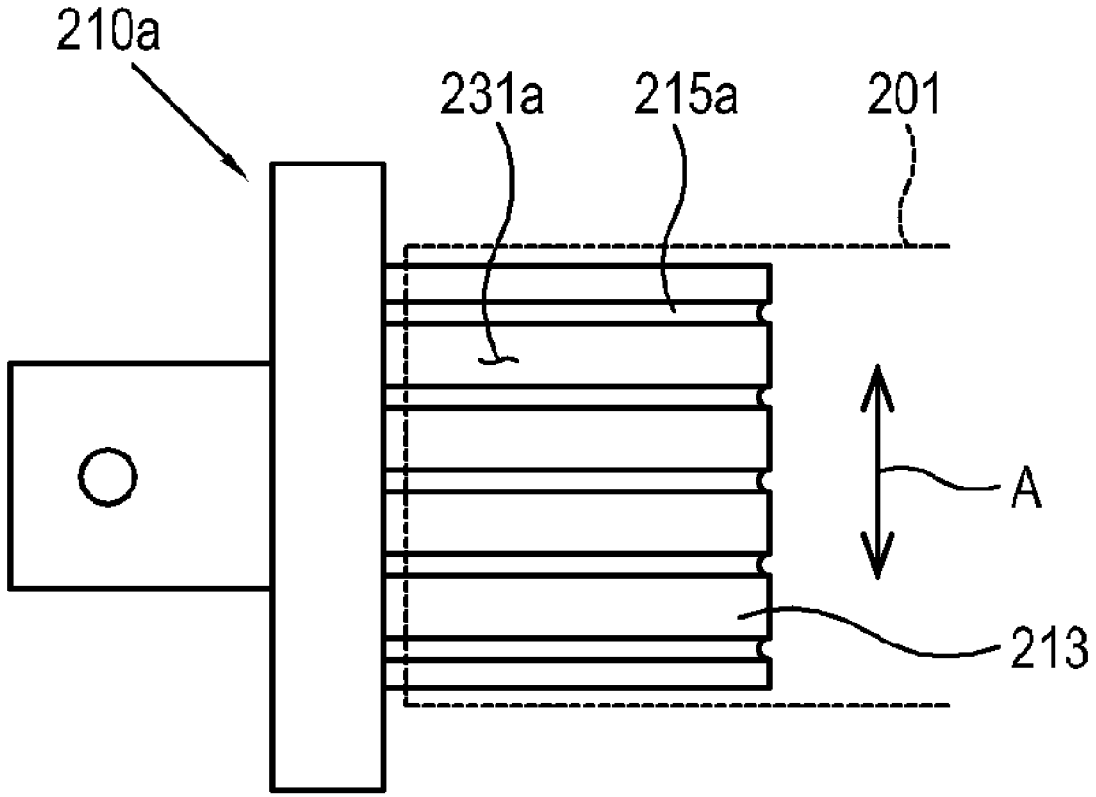
FIGS. 6 to 8 are enlarged plan views of end supporting members including various lubricant containers, according to exemplary embodiments of the present invention.

FIGS. 6 to 13 illustrate exemplary embodiments of end supporting members 210*a*-210*d* and 260. In FIG. 6, the end supporting member 210*a* includes lubricant containers 215*a*. The lubricant containers 215*a* are grooves formed perpendicular to the rotation direction A of the belt 201. The lubricant may be more efficiently moved from the lubricant containers 215*a*, to a belt contacting surface 213*a* of the supporter 213, as compared to the lubricant container 215 of FIG. 5.

Figure 7:
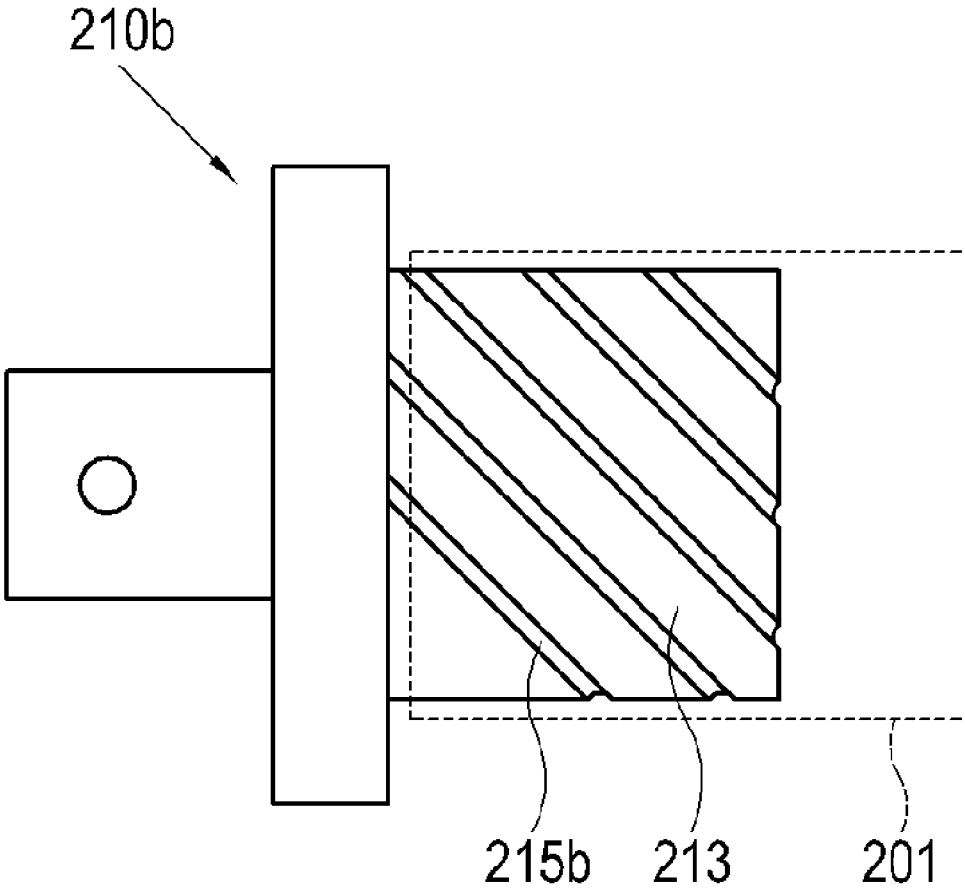

FIG. 7 the end supporting member 210*b* includes lubricant containers 215*b*. The lubricant containers 215*b* are grooves formed at an angle, with respect to the rotation direction A of the belt 201.

Referring to FIGS. 5-7, the lubricant is released more slowly from the lubricant containers 215 than from the lubricant containers 215*a*. The lubricant is released from the lubricant containers 215*b* more quickly than from the lubricant containers 215, and more slowly than from the lubricant containers 215*a*.

Figure 8:
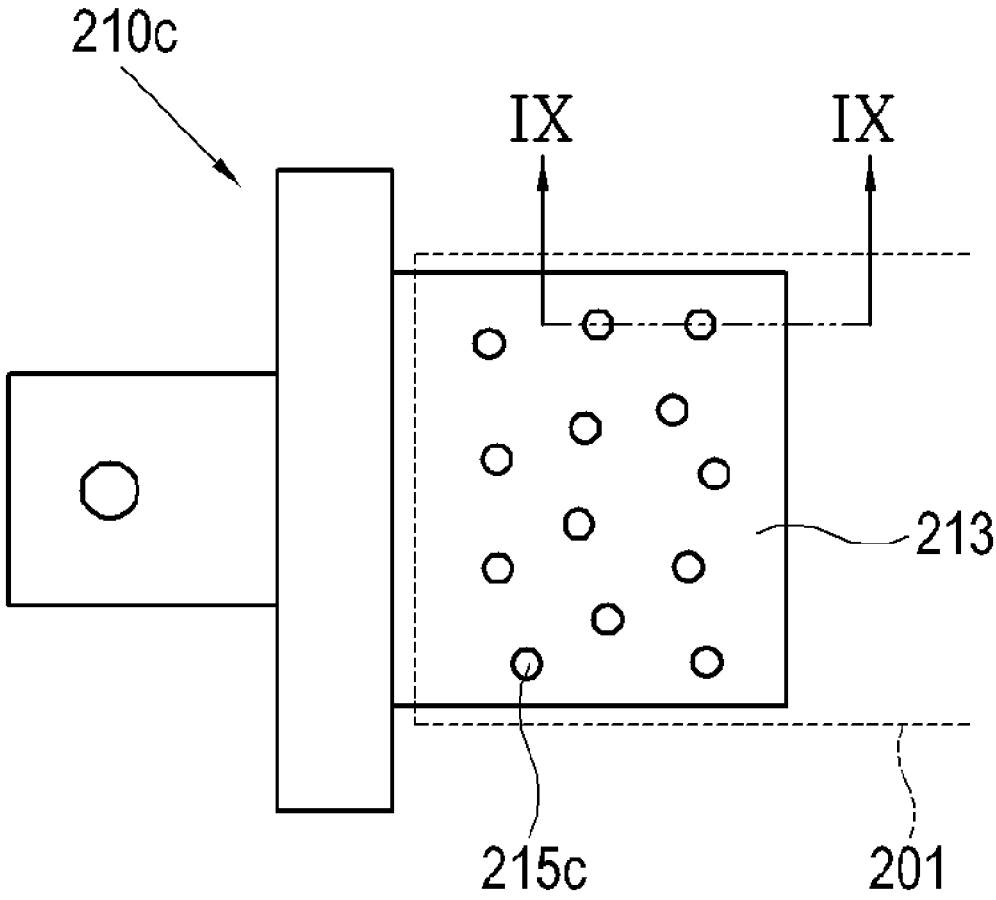
Figure 9:
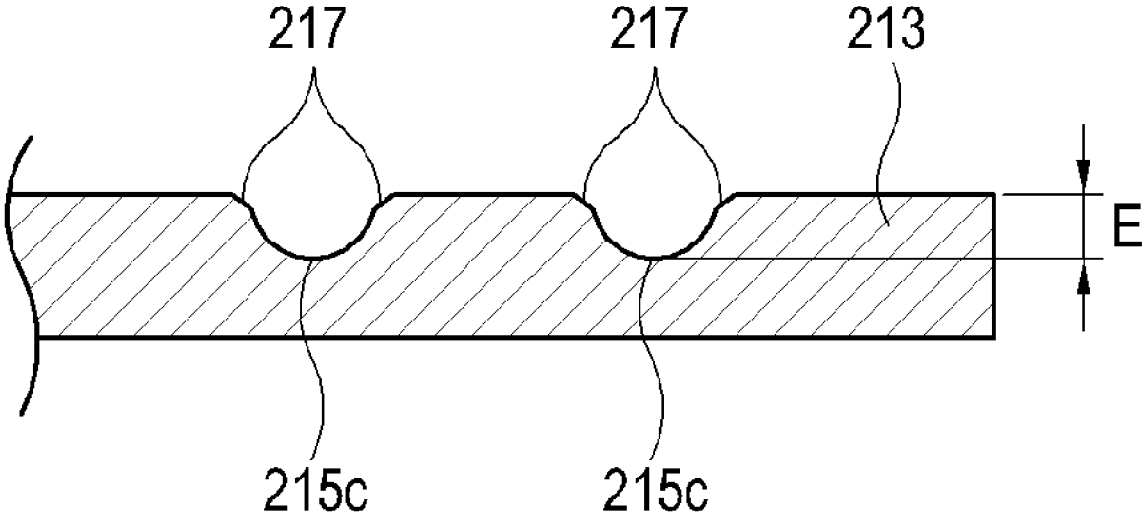
FIG. 9 is a sectional view taken along line IX-IX of FIG. 8.

As shown in FIGS. 8 and 9, the end supporting member 210*c* includes lubricant containers 215*c*, which are a plurality of dents formed in the supporter 213. The lubricant containers 215*c* are formed in a predetermined pattern that can reduce wrinkling of the belt 201, and/or bending of the printing medium. According to some exemplary embodiments, the depth E of the lubricant containers 215*c* ranges from approximately 0.1 mm to 2 mm.

As shown in FIG. 9, the lubricant containers 215*c* may have chamfers 217, such that the edges thereof are beveled. The chamfers 217 may be included with any of the lubricant containers described herein.

Figure 10:
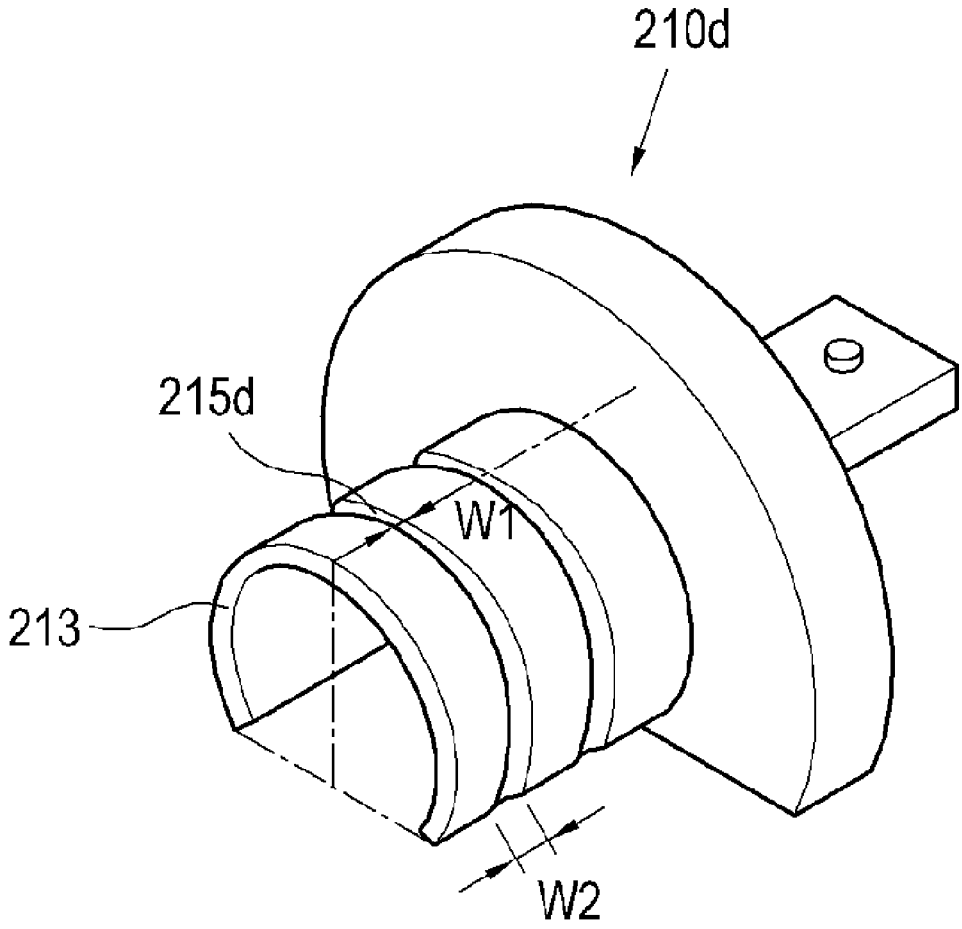
FIG. 10 is a perspective view of an end supporting member including a lubricant container, according to an exemplary embodiment of the present invention.
Figure 11:
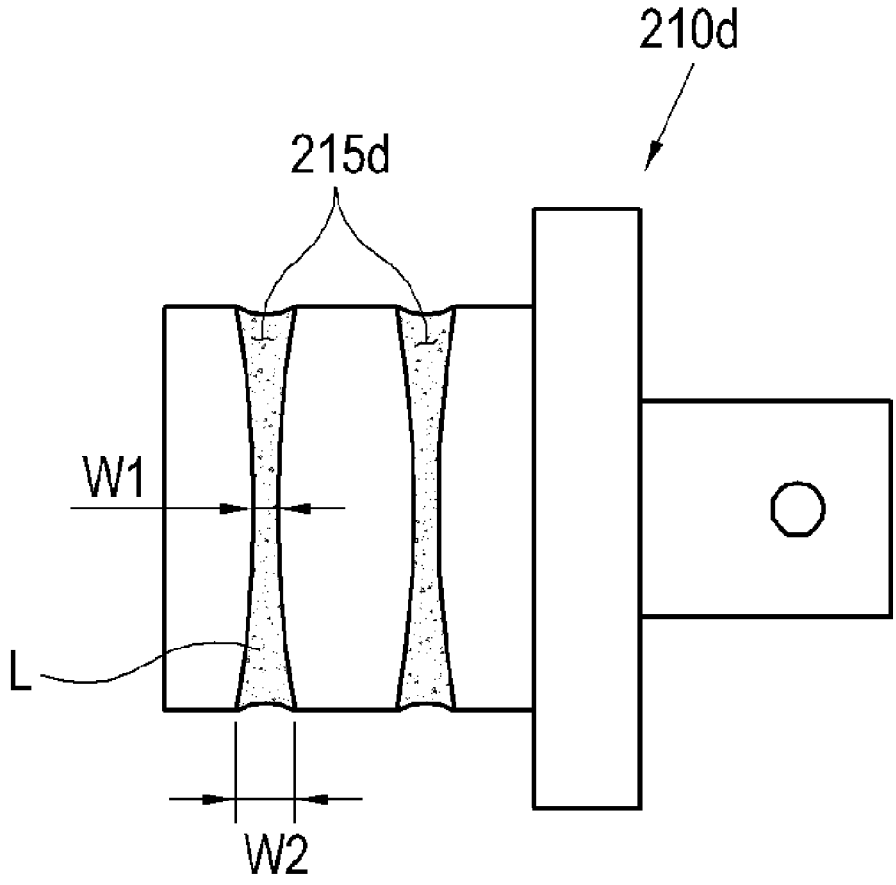
FIG. 11 is a plan view of the end supporting members of FIG. 10.

FIGS. 10 and 11 are a perspective view and a plan view of the end supporting member 210*d*. As shown in FIG. 10, the width of the lubricant containers 215*d* may range between a more narrow width W1 and a wider width W2.

Referring again to FIG. 3A, the belt 201 is in a non-tension state, and rotates according to the rotation of the pressure member 150. The contact area between the belt 201 and the end supporting member 210 is greatest when the nip N of the supporter 213 faces the belt 201, and the contact area is the smallest went the nip N does not face the belt 210. Thus, it is more efficient to varying the filling amount of the lubricant according to the size of the contact area. The widths of the lubricant containers 215*d* in FIGS. 10 and 11 vary, such that the amount of the lubricant in portions of the lubricant containers 215*d*, is greatest when the contact area is the greatest. Alternatively, the depth of the lubricant container 215*d* may be varied, such that the filling amount of the lubricant varies according to the contact area.

Figure 12:
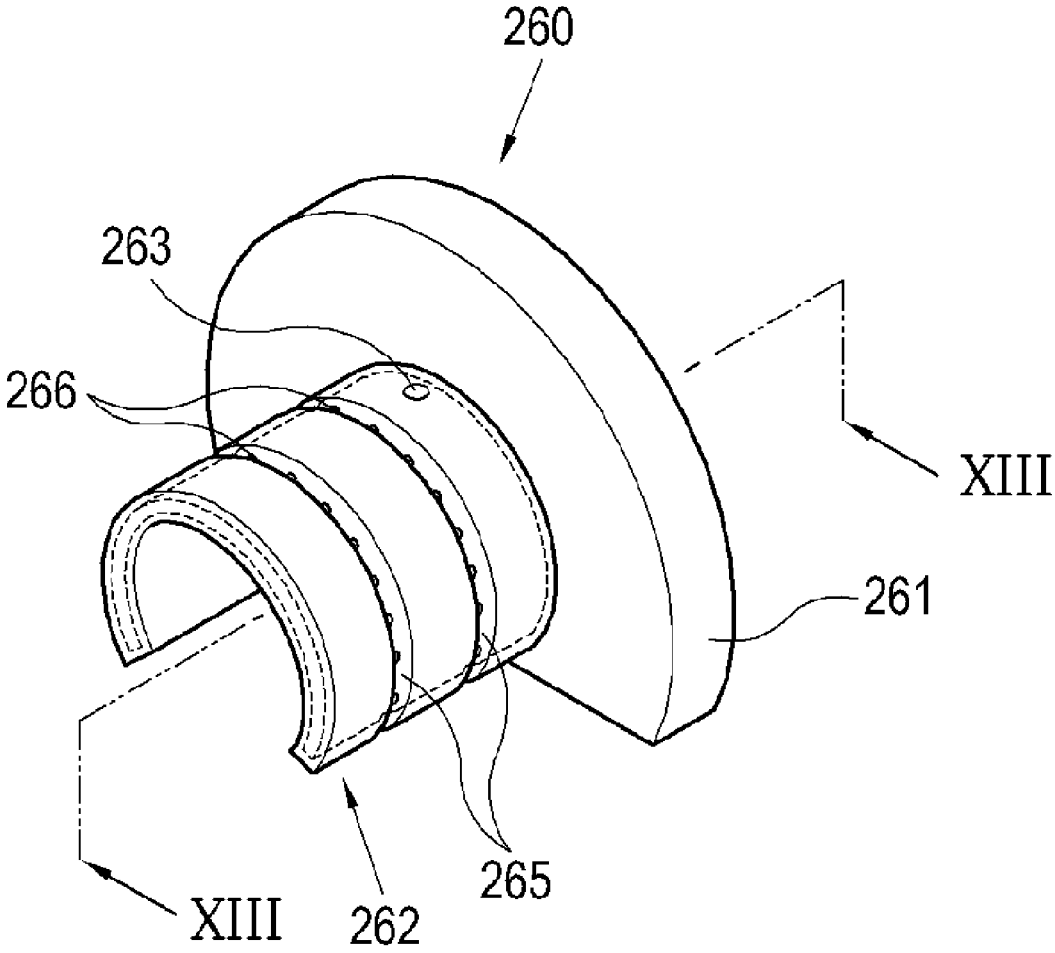
FIG. 12 is a perspective view of an end supporting member including a lubricant storage unit, according to an exemplary embodiment of the present invention.
Figure 13:
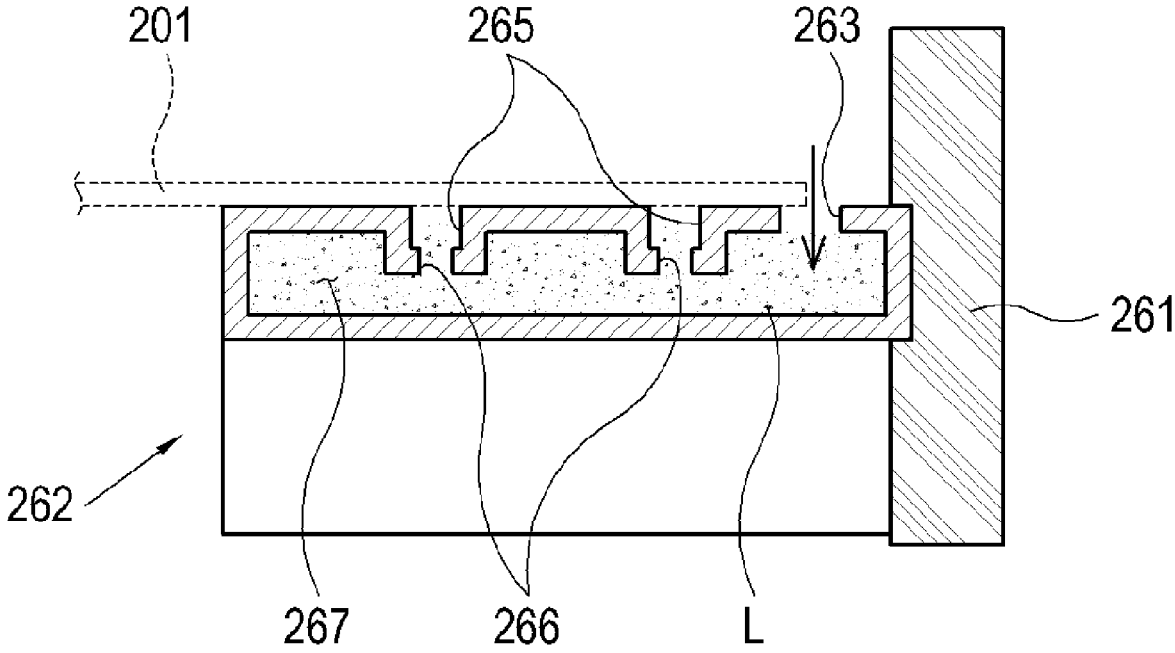
FIG. 13 is a sectional view taken along line XIII-XIII of FIG. 12.

FIGS. 12 and 13 illustrate a perspective view and a sectional view of an end supporting member 260, according to an exemplary embodiment of the present invention. The end supporting member 260 includes a separation prevention unit 261 that prevents the belt 201 from being separated along an axis of rotation, and a supporter 262 having a lubricant storage unit 267 therein.

The supporter 262 supports the inside of an end of the belt 201, and is coupled with the separation prevention unit 261. Lubricant containers 265 contain a lubricant L, and are formed in the supporter 262. The lubricant containers 265 are shown as grooves in FIGS. 12 and 13, but not limited thereto. Alternatively, the lubricant containers 265 may be, for example, a plurality of scattered dents.

The supporter 262 includes a lubricant supplying opening 263, through which lubricant is supplied into the lubricant storage unit 267. The lubricant supplying opening 263 is disposed outside of the belt 201, so as to be easily filled.

The lubricant container 265 has lubricant communication paths 266, to communicate with the lubricant storage unit 267. As shown therein, the lubricant communication paths 266 (through holes). As shown in FIG. 12, the through holes 266 may be disposed to communicate with the lubricant containers 265. The present invention is not limited to any particular number or orientation of through holes 266.

As the belt 201 rotates the lubricant L is expended from lubricant containers 265. As the lubricant is expended, the pressure of the lubricant containers 265 becomes relatively lower than that of the lubricant storage unit 267. The lubricant L stored in the lubricant storage unit 267 is then supplied to the lubricant containers 265, through the through holes 266, to replenish the supply of the lubricant L, which is applied to the external circumference of the supporter 262. The lubricant makes the belt 201 move smoothly, thereby extending the lifespan of the belt 201, the fusing unit 200, and the image forming apparatus 100.

As described above, a fusing unit, and an image forming apparatus including the same can: increase the life span of a belt; reduce friction at opposite ends of the belt; apply a lubricant between the belt and end supporting members, for a long time; and reduce a driving torque applied to drive the belt.

While there have been illustrated and described what are considered to be exemplary embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. Accordingly, it is intended, therefore, that the present invention not be limited to the various exemplary embodiments disclosed, but that the present invention includes all embodiments falling within the scope of the appended claims.

What is claimed is:

1. A fusing unit of an image forming apparatus, comprising:

a belt; and a first end supporting member and a separate second end supporting member, the first end supporting member and the separate second end supporting member disposed at opposing ends of the belt, to support the opposing ends as the belt rotates, wherein at least one of the first and second end supporting members has a lubricant container formed in a surface thereof, to supply a lubricant to lubricate the rotation of the belt, wherein at least one of the first and the second end supporting members further comprises a supporter which is disposed inside of the belt and protruded toward the belt, wherein the lubricant container is formed directly in an exterior curved surface of the supporter, and wherein the belt is fitted on the exterior curved surface of the supporter.

2. The fusing unit according to claim 1, wherein the lubricant container is formed as at least one groove.

3. The fusing unit according to claim 2, wherein the groove extends in a direction substantially parallel to a rotational axis of the belt, substantially perpendicular to the rotational axis, or substantially offset from the rotational axis.

4. The fusing unit according to claim 1, wherein the lubricant container extends in a direction substantially parallel to a rotational axis of the belt, substantially perpendicular to the rotational axis, or substantially offset from the rotational axis.

5. The fusing unit according to claim 1 wherein the lubricant container is formed as a plurality of dents.

6. The fusing unit according to claim 1, wherein the at least one first and second end supporting member has a lubricant storage unit defined therein, to store the lubricant, and a lubricant communication path extending between the lubricant storage unit and the lubricant container.

7. An image forming apparatus, comprising:

an image forming unit to form an image on a printing medium with a developer; and a fusing unit to fuse the developer on the printing medium, comprising:

a belt, and a first end supporting member and a separate second end supporting member, the first end supporting member and the separate second end supporting member disposed at opposing ends of the belt, to support the opposing ends as the belt rotates, wherein the at least one first and second end supporting member has a lubricant container formed in a surface thereof, to supply a lubricant to lubricate the rotation of the belt, wherein at least one of the first and the second end supporting members further comprises a supporter which is disposed inside of the belt and protruded toward the belt, wherein the lubricant container is formed directly in an exterior curved surface of the supporter, and wherein the belt is fitted on the exterior curved surface of the supporter.

8. The image forming apparatus according to claim 7, wherein the lubricant container is formed as at least one groove.

9. The image forming apparatus according to claim 8, wherein the groove extends in a direction substantially parallel to a rotational axis of the belt, substantially perpendicular to the rotational axis, or substantially offset from the rotational axis.

10. The image forming apparatus according to claim 7, wherein the lubricant container extends in a direction substantially parallel to a rotational axis of the belt, substantially perpendicular to the rotational axis, or substantially offset from the rotational axis.

11. The image forming apparatus according to claim 7, wherein the lubricant container is formed as a plurality of dents.

12. The image forming apparatus according to claim 7, wherein the least one first and second end supporting member has a lubricant storage unit defined therein, to store the lubricant, and a lubricant communication path to connect the lubricant storage unit and the lubricant container.

13. A fusing unit of an image forming apparatus, comprising:

a belt; and a first end supporting member and a separate second end supporting member, the first end supporting member and the separate second end supporting member disposed at opposing ends of the belt, to support the opposing ends as the belt rotates, the first and second end supporting members each having grooves formed in a surface thereof, to supply a lubricant to lubricate the rotation of the belt, wherein at least one of the first and the second end supporting members further comprises a supporter which is disposed inside of the belt and protruded toward the belt, wherein the lubricant container is formed directly in an exterior curved surface of the supporter, and wherein the belt is fitted on the exterior curved surface.

14. The fusing unit according to claim 13, wherein the grooves extend in a direction substantially parallel to a rotational axis of the belt, substantially perpendicular to the rotational axis, or substantially offset from the rotational axis.

15. The fusing unit according to claim 13, wherein the widths of the grooves increase from central portions to end portions of the grooves.

16. The fusing unit according to claim 13, wherein the depths of the grooves increase from central portions to end portions of the grooves.

17. The fusing unit according to claim 13, wherein edges of the grooves are beveled.

18. The fusing unit according to claim 13, wherein the first and second end supporting members have a lubricant storage units defined therein, to supply the lubricant to the grooves.

19. The fusing unit of claim 18, wherein the first and second end supporting members have through holes defined therein, to connect the lubricant storage units to the grooves.

20. A lubricating unit of an image forming apparatus including a belt, the lubricating unit comprising:

a first member at one end of the belt and supporting a part of the belt; and a second member separated from the first member at another end of the belt and supporting another part of the belt, wherein at least one of the first and the second members further comprises a supporter which is disposed inside of the belt and protruded toward the belt, and wherein a lubricant container is formed directly in an exterior curved surface of the supporter, and wherein the belt is fitted on the exterior curved surface of the supporter.

21. A fusing unit of an image forming apparatus, the fusing unit comprising:

a belt;

a pressure member;

a nip forming member disposed inside the belt to form a nip;

a belt guide coupled with the nip forming member inside the belt to prevent the belt from being deformed and to be biased toward the pressure member;

a first member at one end of the belt and supporting a part of the belt; and a second member separate from the first member at another end of the belt and supporting another part of the belt, wherein at least one of the first and the second members further comprises a supporter which is disposed inside of the belt and protruded toward the belt, wherein a lubricant container is formed directly in an exterior curved surface of the supporter, and wherein the belt is fitted on the exterior curved surface of the supporter.

* * * * *